US006817484B2

(12) United States Patent
Morin et al.

(10) Patent No.: US 6,817,484 B2
(45) Date of Patent: Nov. 16, 2004

(54) CONTAINER FOR A STACK OF INTERFOLDED TISSUE SHEETS AND A METHOD FOR MANUFACTURING SUCH A CONTAINER

(75) Inventors: Emmanuelle Morin, Paris (FR); Urban Widlund, Pixbo (SE)

(73) Assignee: SCA Hygiene Products GmbH, Mannheim (DE)

( * ) Notice: Subject to any disclaimer, the term of this patent is extended or adjusted under 35 U.S.C. 154(b) by 0 days.

(21) Appl. No.: 09/983,851

(22) Filed: Oct. 26, 2001

(65) Prior Publication Data

US 2002/0056719 A1 May 16, 2002

Related U.S. Application Data

(60) Provisional application No. 60/243,441, filed on Oct. 27, 2000.

(51) Int. Cl.[7] ..... A47K 10/42
(52) U.S. Cl. ..... 221/48; 221/63; D6/518
(58) Field of Search ..... 206/233; D6/518; 221/63, 47, 48, 33

(56) References Cited

U.S. PATENT DOCUMENTS

| | | | | | |
|---|---|---|---|---|---|
| 1,737,645 | A | * | 12/1929 | Cubberley | 221/63 |
| D131,684 | S | * | 3/1942 | Feinberg et al. | 221/73 |
| 2,580,982 | A | * | 1/1952 | Weiss | 221/48 |
| 2,840,267 | A | * | 6/1958 | Nelson | 221/48 |
| 3,002,668 | A | * | 10/1961 | Castelli | 225/52 |
| 4,289,262 | A | * | 9/1981 | Finkelstein | 225/106 |
| 4,526,291 | A | * | 7/1985 | Margulies | 221/63 |
| 4,535,912 | A | * | 8/1985 | Bonk | 221/46 |
| 4,540,091 | A | * | 9/1985 | Habock | 206/494 |
| 4,586,630 | A | | 5/1986 | Loder | |
| 4,877,154 | A | * | 10/1989 | Matsui | 221/48 |
| 5,024,349 | A | * | 6/1991 | Haenni et al. | 221/46 |
| 5,325,992 | A | * | 7/1994 | Koller et al. | 221/63 |
| 5,516,001 | A | * | 5/1996 | Muckenfuhs et al. | 221/63 |
| 5,542,568 | A | * | 8/1996 | Julius | 221/63 |
| 5,938,069 | A | * | 8/1999 | Macchia | 221/48 |
| 6,053,357 | A | | 4/2000 | Yoh | |
| 6,371,296 | B1 | * | 4/2002 | Rumbough | 206/494 |
| 6,409,044 | B1 | * | 6/2002 | Brown et al. | 221/63 |
| 6,419,114 | B1 | * | 7/2002 | Lenz et al. | 221/47 |
| 6,499,626 | B1 | * | 12/2002 | Julius | 221/63 |
| 6,758,369 | B2 | * | 7/2004 | Morin et al. | 221/48 |
| 2002/0179625 | A1 | * | 12/2002 | Huang et al. | 221/63 |
| 2002/0179626 | A1 | * | 12/2002 | Huang et al. | 221/63 |
| 2002/0190074 | A1 | * | 12/2002 | Morin et al. | 221/63 |
| 2003/0155264 | A1 | * | 8/2003 | Morin | 206/494 |
| 2003/0221986 | A1 | * | 12/2003 | Reinke et al. | 206/494 |

FOREIGN PATENT DOCUMENTS

| | | | | |
|---|---|---|---|---|
| EP | 748748 | * | 12/1996 | B65D/83/08 |
| FR | 2691697 | * | 12/1993 | 221/48 |
| GB | 2235431 | * | 3/1991 | 221/63 |
| WO | 98/19946 | | 5/1998 | |

* cited by examiner

*Primary Examiner*—Donald P. Walsh
*Assistant Examiner*—Daniel K Schlak
(74) *Attorney, Agent, or Firm*—Burns, Doane, Swecker & Mathis, L.L.P.

(57) ABSTRACT

The invention relates to a container for a stack of interfolded tissue sheets. The container has a generally planar bottom wall and a top wall and side walls connecting the bottom wall with the top wall. An opening is provided in the top wall for the removal of the tissue-sheets from the container, which opening is wider than the width of the tissue-sheets. The stack of interfolded tissue-sheets is placed in the container with a lowermost tissue-sheet placed on the bottom wall and an uppermost tissue-sheet placed near or in contact with the top wall and adjacent to the opening in the top wall. The opening is provided with a positioning feature having elongated, overlapping projections extending from opposite sides of the opening in order to allow the uppermost tissue-sheet to be dispensed, holding it substantially flat. The invention also relates to a method for producing the positioning feature.

12 Claims, 6 Drawing Sheets

CONTAINER FOR A STACK OF INTERFOLDED TISSUE SHEETS AND A METHOD FOR MANUFACTURING SUCH A CONTAINER

CROSS-REFERENCE TO RELATED APPLICATION

This application claims priority under 35 U.S.C. §119(e) to U.S. application Ser. No. 60/243,441 filed on Oct. 27, 2000; the entire content of which is hereby incorporated by reference.

TECHNICAL AREA

The invention pertains to a stack of interfolded tissue-sheets packed in a container, said container having a generally planar bottom wall and a top wall and side walls connecting the bottom wall with the top wall and an opening provided in at least one wall for the removal of said tissue-sheets from the container, said stack of interfolded tissue-sheets being placed in said container with at least the edges of a lowermost tissue-sheet placed on the bottom wall and an uppermost tissue-sheet placed near or in contact with the top wall and adjacent to the opening in the top wall.

BACKGROUND OF THE INVENTION

Soft tissue sheets such as facial tissue sheets are commonly offered as a stack of tissue sheets packed in a dispensing box. The dispensing box has an opening through which the user pulls the tissue sheets. In order to facilitate the removal of the tissue sheets from the dispensing box, the tissue sheets are interfolded, which means that the tissue sheets are folded into one-another, so that they form a chain of tissue sheets being interconnected by folded portions. In this manner, when removing the top tissue sheet from the stack of tissue sheets and pulling the tissue sheet completely through the dispensing opening in the dispensing box, the pulled-out tissue sheet will automatically bring a portion of the next tissue sheet in the stack out through the opening thereby making it readily available for gripping and removing from the dispensing box. The praxis of interfolding tissue sheets in this manner is a convenient way of ascertaining that all of the tissue sheets can be easily removed from the container. There are many types of interfolding, e.g., Z-folding, but neither the type of interfolding, nor the type of tissue is important to the invention.

A dispenser of this type is known from U.S. Pat. No. 6,053,357 (YOH), which discloses a box with a dispensing opening having a curvilinear or "S"-shape. The opening facilitates the dispensing of interfolded tissues from a box by fixing the top sheet in a position extending out through the opening, where it is readily accessible to a user.

However, a problem arises when it is desired to dispense a flat tissue sheet from the stack of tissue sheets. After opening the dispensing box, which basically means exposing the opening in the box, the user must try and get a grip on the first tissue sheet in order to remove it. In ordinary boxes of this type, the uppermost tissue is usually wrinkled when it is presented to the user through the opening in the box. The reason for this is that the width of the tissue is broader than the opening in the box, in order to fix the tissue in a position ready to use. To dispense a flat tissue sheet it is therefore necessary to have a wider opening in the box. Although a wider opening in the box solves the problem with tissues being wrinkled as they are pulled out of the box, it creates a further problem with tissues falling back into the box where they are inaccessible for the user.

SUMMARY OF THE INVENTION

The present invention offers a simple and expedient means of solving the problem of dispensing a flat tissue sheet from a stack of interfolded tissue sheets which are packed in a container having a dispensing opening. In a preferred embodiment, the opening is wider than the width of said tissue sheets. The invention will, however, also be applicable for openings of equal or narrower width than the width of the tissue sheets.

In accordance with the invention the dispensing opening is provided with means for presenting a tissue blocked in a fixed position, with a flat configuration. This allows the user to pull the presented tissue out flat, whereby potential wrinkling is smoothened out by the presenting means. The presented tissue may be a single sheet, or may itself have additional folding.

The means for presenting the tissue is preferably in the form of a number of elongated projections or fingers extending from opposite sides of the dispensing opening of the box. The dispensing opening is preferably, but not necessarily, located in the top wall of the box. In order to fix a tissue in position the fingers are overlapping either by being positioned one on top of the other or by extending between each other. As the box is opened the fingers are initially arranged in substantially the same plane, until the first tissue has been extracted through the dispensing opening. The fingers are preferably attached to the underside of the top wall of the box, on opposite sides of the opening. It is, however, also possible to attach the means including said fingers on the upper side of the top wall of the box, or to integrate it into the top wall itself, e.g., by making the fingers part of the top wall. When the first tissue is being pulled out through the opening, the fingers will be pulled upwards by the tissue on either side thereof. The pulled-out tissue will automatically bring a portion of the next tissue out through the opening, where it will pass between the fingers. As the first tissue is removed, the following tissue will be held in position and prevented from falling back into the box by the gripping action of the opposing fingers. The fingers must be sufficiently flexible to allow a tissue to be pulled out, while at the same time being sufficiently stiff to retain the tissue and prevent it from falling back. Accordingly, the thickness and stiffness of a plastic film, or other suitable material, used for the fingers must be selected to match the stiffness and material properties of the tissue.

It is possible to produce opposing sets of fingers from a continuous sheet of material by using a profile for the fingers that can be offset from opposite sides of the edge of said sheet. If the finger profile is substantially V-shaped, a zig-zag cut can be made along the longitudinal axis of the continuous sheet. Sets of opposing fingers can be cut to length from the resulting halves. Fingers of this type can be arranged in pairs, overlapping and in contact with a directly opposing finger, or staggered, having fingers arranged side-by-side and overlapping by extending across the dispensing opening of the box. Alternatively the fingers can be angled relative to the longitudinal axis of the opening, in which case each finger may overlap one or more opposing fingers as it extends across the dispensing opening.

In the following text, the term "overlap" is used to denote that the tips of a pair of adjacent projections, which are not necessarily in contact, extend past each other, as seen in a plan view. The term "contacting overlap" is used to describe an arrangement of projections extending over/under one another and being in contact with each other.

BRIEF DESCRIPTION OF FIGURES

The invention will in the following be described in greater detail, with reference to the figures which are shown on the appended drawings. These drawings are schematic and do not limit the scope of the invention. In the drawings.

DETAILED DESCRIPTION OF EMBODIMENTS

Figure 1:
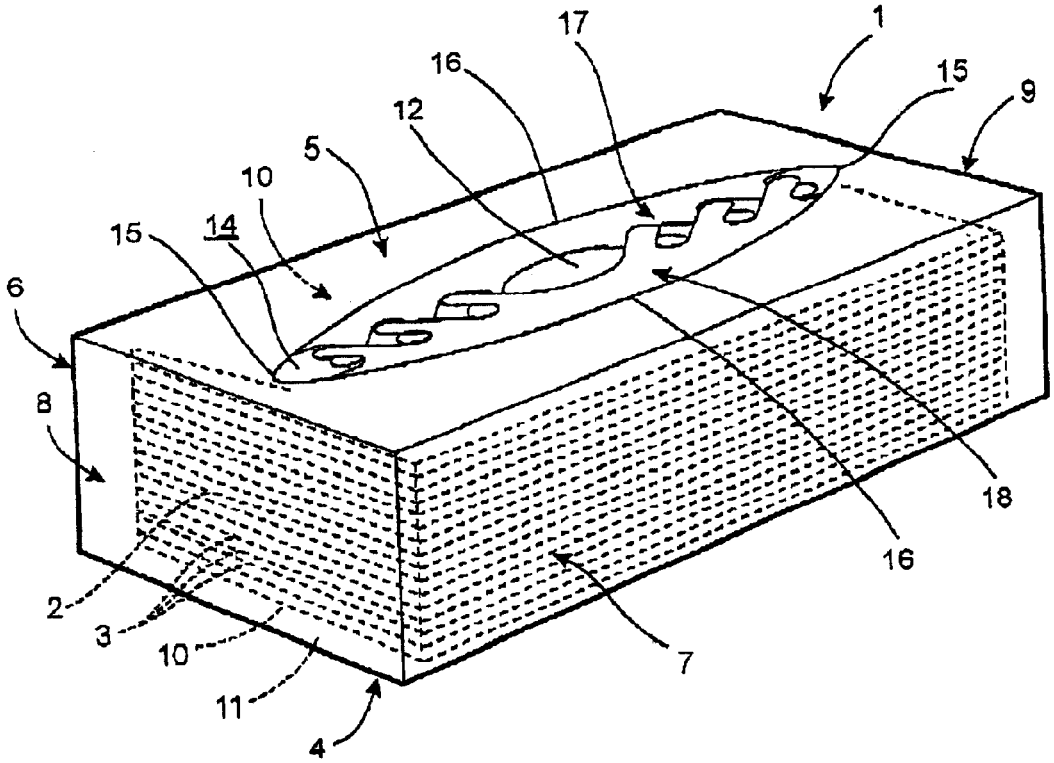
FIG. 1 shows a box of packaged tissue-sheets with positioning means in accordance with a first embodiment of the invention.

FIG. 1 shows a generally rectangular paperboard dispensing box 1 containing a stack 2 of interfolded tissue-sheets 3. By interfolding, all the tissue-sheets 3 in the stack 2 are mechanically connected to each other in a continuous, loosely connected band of individual tissue-sheets 3. The paperboard box 1 has a bottom wall 4, a top wall 5, two long side walls 6, 7 and two short side walls 8, 9. The stack 2 of tissue-sheets 3 rests with a lower-most tissue-sheet 10 on the inner surface 11 of the bottom wall 4 and has a height which substantially corresponds to the height of the box 1, that is, to the height of the side walls 6–9. It is to be understood, that the height of the stack 2 of tissue-sheets is to a certain degree determined by the height of the box. The interfolded tissue-sheets 3 are highly compressible and are usually, but not necessarily, compressed before being placed in the box, so that a sufficient amount of tissue-sheets can be accommodated in the box.

The box 1 is provided with an opening 14 in the top wall 5. The opening 14 is arranged generally centrally in the top wall 5 and extends parallel to the long side walls 6, 7. The opening 14 has a generally oval shape with rounded ends 15 and slightly outwardly curved side edges 16, so that the opening 14 is wider at a central portion than at the ends. In order to allow tissue-sheets to be removed flat, without wrinkling, the width of the opening 14 between its rounded ends 15 must be wider than the tissue-sheets. Before use of the box of tissue-sheets, the opening 14 is commonly protected by a cover. Usually the protective cover is made of the same paperboard material as the box itself, and is simply a portion of the top wall 5, which can be torn away along a perforated line in the top wall 5. However, other protective devices such as separate pieces of paper, paperboard, plastic film, and the like can be envisaged. Moreover, the box can be provided with a permanently attached or removable regular lid which is opened to expose the opening in the top wall 5 and which, optionally, can be reclosed.

Moreover, the opening in the top wall 5 need not have the described oval shape. Hence, rectangular openings, circular openings or openings having irregular shapes are contemplated within the scope of the invention. In addition, the opening need not be arranged only in the top wall but could extend into one or two side walls. Positioning means 17, 18 are attached to the underside of the top wall 5 on either side of the opening 14, along both the curved side edges 16. As the opening 14 is wider than the width of the tissue-sheets 12, the positioning means 17, 18 prevents the uppermost tissue-sheet 12 from falling back into the box. In FIG. 1 the positioning means is shown as a number of opposing projections in contacting overlap, where the projections are angled relative to each other and to a longitudinal axis through the opening 14.

Figure 2A:
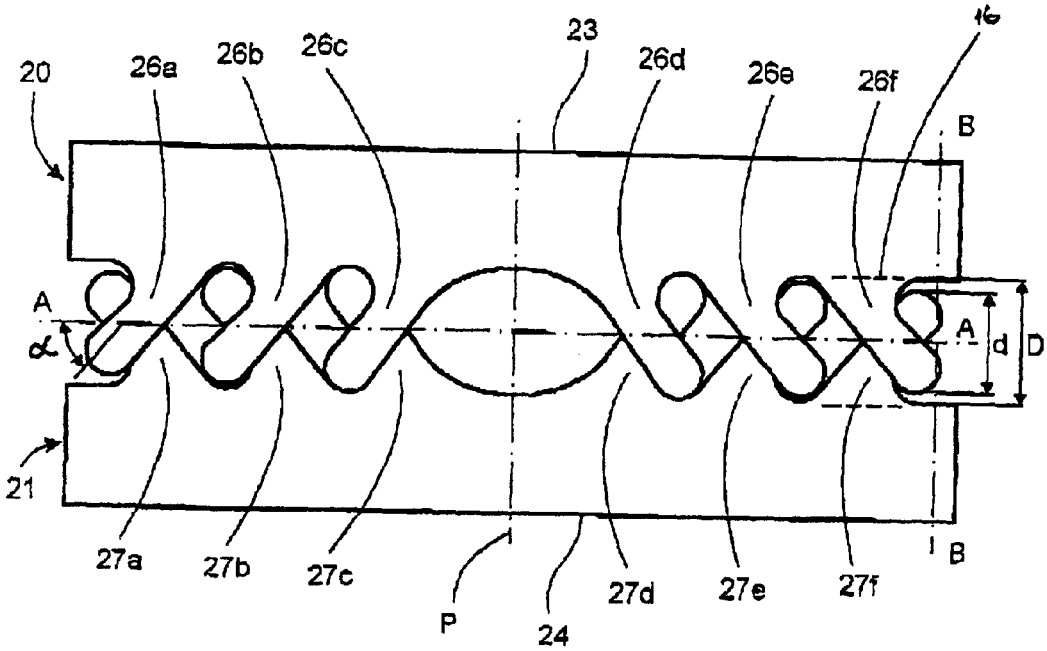
FIG. 2A shows a plan view of the positioning means of the first embodiment of the invention in its initial position.

FIG. 2A shows a plan view of the positioning means and its overlapping projections in their initial position, before the first tissue-sheet has been pulled out. In this case the positioning means comprises two sections 20, 21 which are identical and placed opposite each other. Each section 20, 21 has a longitudinal edge 23, 24 for attaching it to the top wall of the box. The uppermost tissue-sheet can be accessed through a central opening 25 between the two sections. On either side of this central opening, the projections are angled away from a transverse plane P through the middle of said central opening and at right angles to the longitudinal axis A of the dispensing opening. This embodiment shows sections 20, 21 having three projections 26*a*, 26*b*, 26*c*; 26*d*, 26*e*, 26*f*; 27*a*, 27*b*, 27*c*; 27*d*, 27*f* on either side of the central opening 25. The projections shown in FIG. 2A are shaped like fingers, having substantially parallel side edges, but they can also be slightly converging towards the tips of the projections. The tips of the projections are preferably rounded. It is of course possible to vary the number of projections within the scope of the invention.

According to an alternative embodiment it is also possible to stagger the above projections in the longitudinal axis A of the box, so that the opposing projections would overlap without being in contact.

The angle $\alpha$ between the longitudinal axis A of the box and the main axis of each projection is preferably $5° \leqq \alpha \leqq 90°$. In this embodiment all projections are extended at the same angle $\alpha$, but it is also possible to use varying angles, e.g., to decrease the angle $\alpha$ for successive projections from the central opening and outwards.

The embodiment also shows projections which are gradually shortened in the direction away from the central opening 25. It is of course also possible to vary the length of the projections in the opposite direction, or to use projections having a constant length. In this embodiment the maximum length of the projections is chosen so that each projection is in contacting overlap with only one of the opposing projections. It is possible, however, to let the projection be in contacting overlap with more than one opposing projection. As the length of the projections varies, then so does the degree of overlap of the opposite projections in the transverse direction of the box. Preferably the degree of overlap should be between 50 and 100%, calculated using the ratio of the distance d between the tips of two opposing and adjacent projections, and the distance D between the opposing side edges 16 of the dispensing opening in a transverse plane B through the tips of the projections. This is valid provided that both fingers extend past the longitudinal axis A of the box, but not past the opposing side edge 16 of the opening (see FIG. 1). The degree of overlap may vary for each pair of opposing fingers, as both the tip distance d and the distance D between the edges of the opening may vary along the longitudinal axis of the box.

Figure 2B:
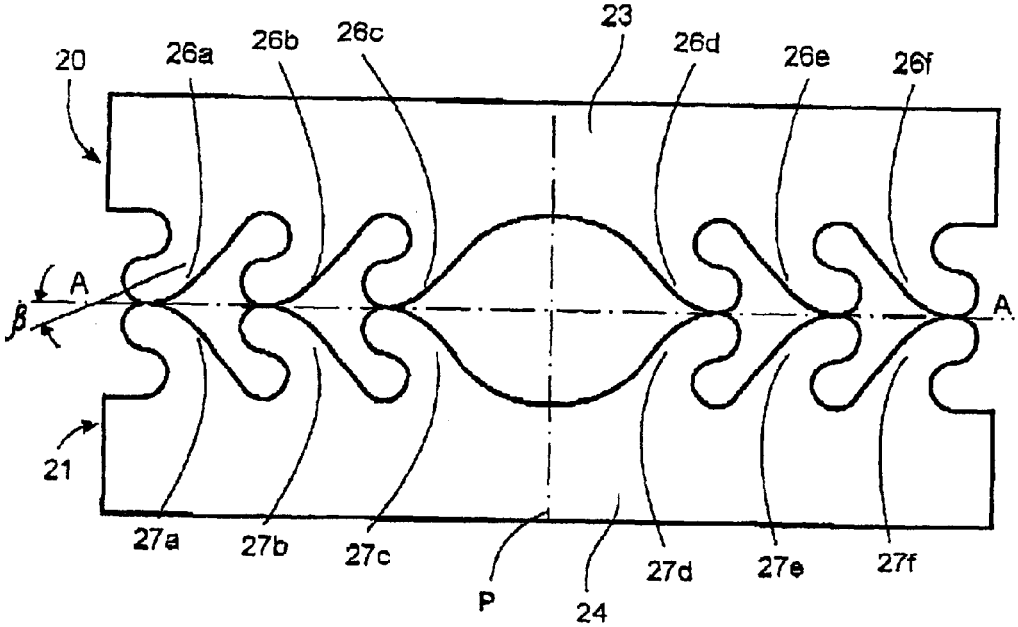
FIG. 2B shows a plan view of the positioning means of the first embodiment of the invention in its active position.

FIG. 2B shows the positioning means of FIG. 2A with a tissue-sheet 12 extending up between the projections 26*a*, 26*b*, 26*c*; 26*d*, 26*e*, 26*f*; 27*a*, 27*b*, 27*c*; 27*d*, 27*e*, 27*f*. As the first tissue-sheet is being pulled up between the projections, bending them from their initial flat positions to their respective active positions, said projections will also be subjected to a twisting movement. As a result, the angle $\alpha$ between the longitudinal axis of the box and the main axis of each projection will gradually decrease towards an angle β as they are being lifted and twisted. The angle β shown in FIG. 2B is the angle of the main axis of projection 26*a* at its point of contact with the tissue-sheet, in the horizontal plane. The reduction of the angle β with respect to the angle α will of course depend on the length and initial angle α of each projection, as well as the degree of overlap between opposing projections. The dotted line indicates a part of the side edges 16 of the dispensing opening.

A further angle between the tips of the projections is the so called gripping angle χ, defined as the angle between two planes at right angles to the surface containing the dispensing opening, wherein each plane intersects a first point, which is the contact point between the projections, and coincides with a line passing at right angles to the main axis of their respective projections and through said first point. In a preferred embodiment, the contact points are located on the edges of the opposing fingers, but this is not a prerequisite for carrying out the invention.

Should the contact point between the opposing projections become a line of contact, said first point would instead be located in the middle of said line of contact.

The angle χ can vary from 0°, e.g., for opposing projections having the angle α equal to 90°, to in excess of 110°, e.g., for extended projections with an angle α approaching 5°. The angle may also vary depending on the stiffness in the material used for the projections.

Apart from giving the projections a better grip in their active positions, angling the projections away from the central opening will cause a stretching or smoothening effect on the tissue-sheet. When the top tissue sheet is being pulled upwards, the projections will straighten temporarily. As the next, second interfolded tissue is pulled into position, and the first tissue is released, the weight of said second tissue sheet will cause the projections to move back into their holding position, fixing the tissue in position for the next user. In doing so, the projections will simultaneously flex downwards, towards the box, and outwards, away from the central opening. This outward movement will cause a stretching or smoothening of the parts of the tissue sheet held between the projections. This feature also makes it possible to use a dispensing opening which is equal to or narrower than the width of the tissue. Although a slight wrinkling of the edges of the tissue sheet may occur as it passes through the opening, said stretching effect in combination with the smoothening effect caused by the tissue being pulled between the projections will allow the tissue sheet to be presented flat to the user.

Figure 3:
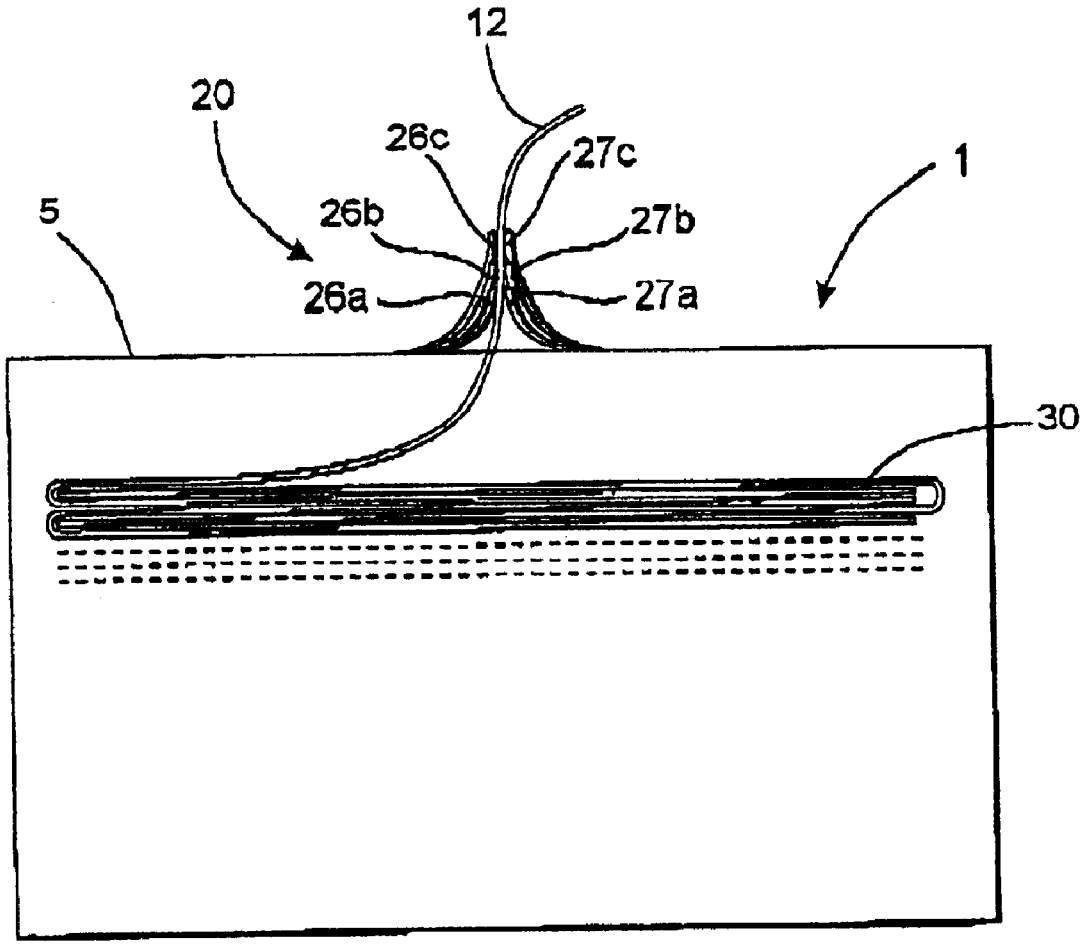
FIG. 3 shows a cross-sectional view of a box according to the first embodiment of the invention.

FIG. 3 shows a cross-section of the box 1 through the transverse plane P. The uppermost tissue-sheet 12 has been pulled out through the dispensing opening 14 and is being presented in a flat, upwardly directed position to the user. The tissue-sheet 12 is being supported from both sides by the opposing projections 26*a*, 26*b*, 26*c*; 26*d*, 26*e*, 26*f*; 27*a*, 27*b*, 27*c*; 27*d*, 27*e*, 27*f* (26*d–f* and 27*d–f* not shown), which have been bent upwards by the action of the first tissue-sheet 12 being removed from the box 1. The tissue-sheet is prevented from falling back into the box by a combination of the compressive forces of the opposing projections acting on either side of the said sheet, and the frictional forces between the projections and the tissue-sheet as the weight of the sheet flexes the projections in a downward direction. The outlined second tissue-sheet 30 indicates the next sheet to be pulled from the box, as well as the present level of tissue-sheets. In their active positions, the projections as shown in this embodiment will always be in point contact with the tissue-sheet, i.e. they will not bend as to lie with their underside flat against the tissue-sheet.

Figure 4:
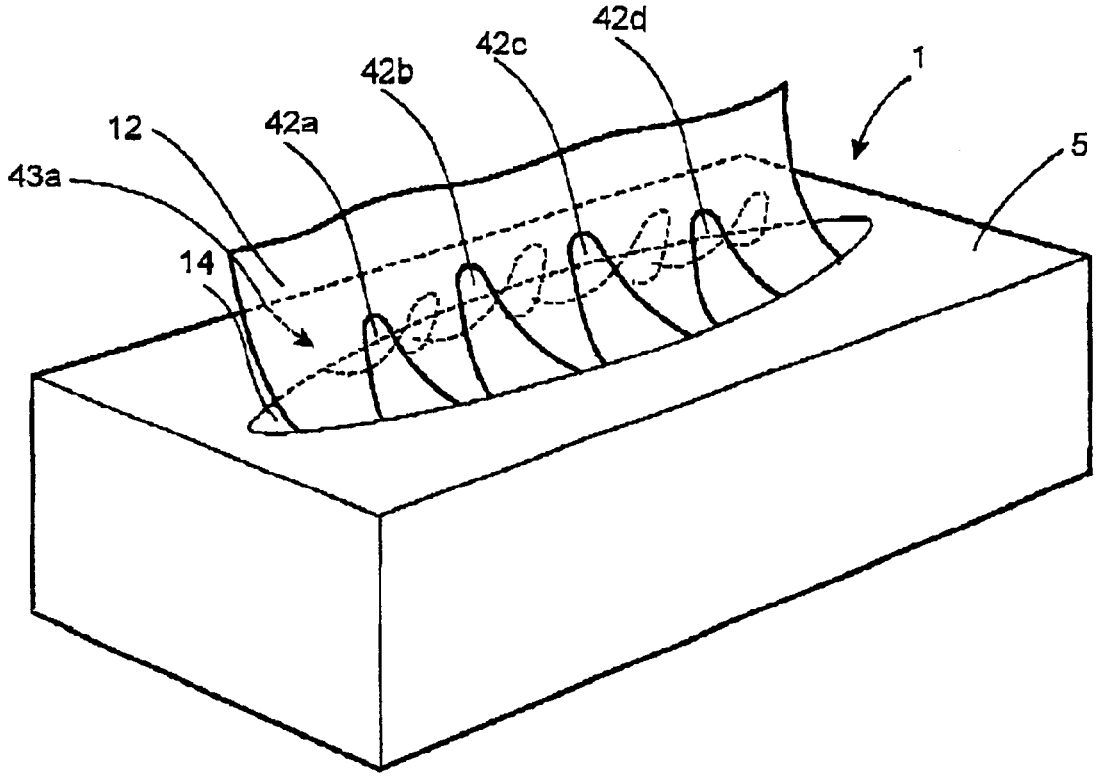
FIG. 4 shows a box of packaged tissue-sheets with positioning means in accordance with a second embodiment of the invention.

In FIG. 4 the positioning means 40, 41 is shown as a number of opposing projections 42*a–d*, 43*a–d* (not shown), where the projections have a general "V"-shape and are positioned between each other, i.e., overlapping in the horizontal plane only without being in contact. The enclosed angle δ (FIG. 5) of the "V"-shape projections can be in the interval $10° \leqq \delta \leqq 170°$, preferably in the interval $30° \leqq \delta \leqq 90°$. The tips of the projections are preferably, but not necessarily, rounded. In this case the dispensing opening 14 of the box 1 extends along the entire length of the top wall 5. Also, the projections 42*a–d*, 43*a–d* only extend along part of this length. Although the projections 42*a–d*, 43*a–d* are preferably made from a relatively thin plastic or other suitable material which gives easy access to the top tissue-sheet, they must also be sufficiently stiff to be able to support the tissue-sheet 12. The type of tissue used therefore decides the number and extension of the projections, as well as the choice of material. As the top tissue-sheet 12 is being pulled out, the projections will be bent upwards from the top wall 5 on either side of the tissue-sheet 12. The first section of the next tissue-sheet will automatically be pulled out and is held flat between the projections 42*a–d*, 43*a–d* in a suitable presentation position for the next user.

Figure 5:
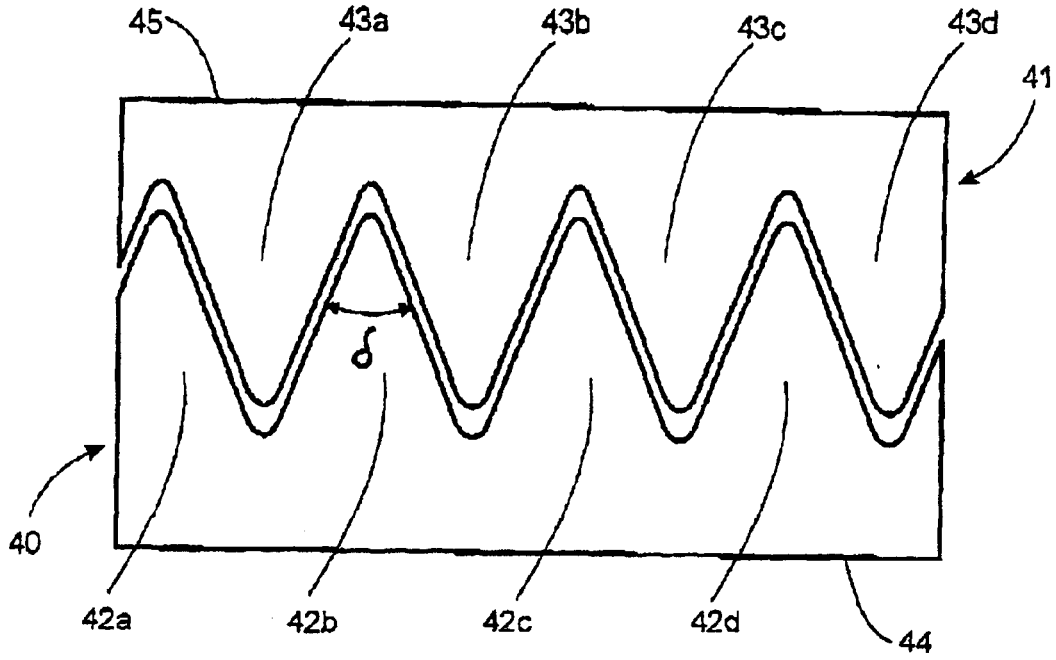
FIG. 5 shows a plan view of the positioning means of the second embodiment of the invention.

FIG. 5 shows a plan view of the positioning means 40, 41 with the projections 42*a–d*, 43*a–d* in their initial positions, before the first tissue-sheet has been removed. As in the embodiment shown in FIG. 2, the positioning means has a longitudinal edge 44, 45 for attachment to the lower surface of the top wall of the box. From this figure it is obvious that the projections 42*a–d*, 43*a–d* can be manufactured from a single continuous sheet of material, using a cutting means having a cutting edge with the same profile as the projections 42*a–d*, 43*a–d*. The cut sheet can then be cut to lengths suitable for the width of the opening 14. As the projections 42*a–d*, 43*a–d* are opposite and identical, they need only be move apart a small distance before being attached to the box.

Figure 6:
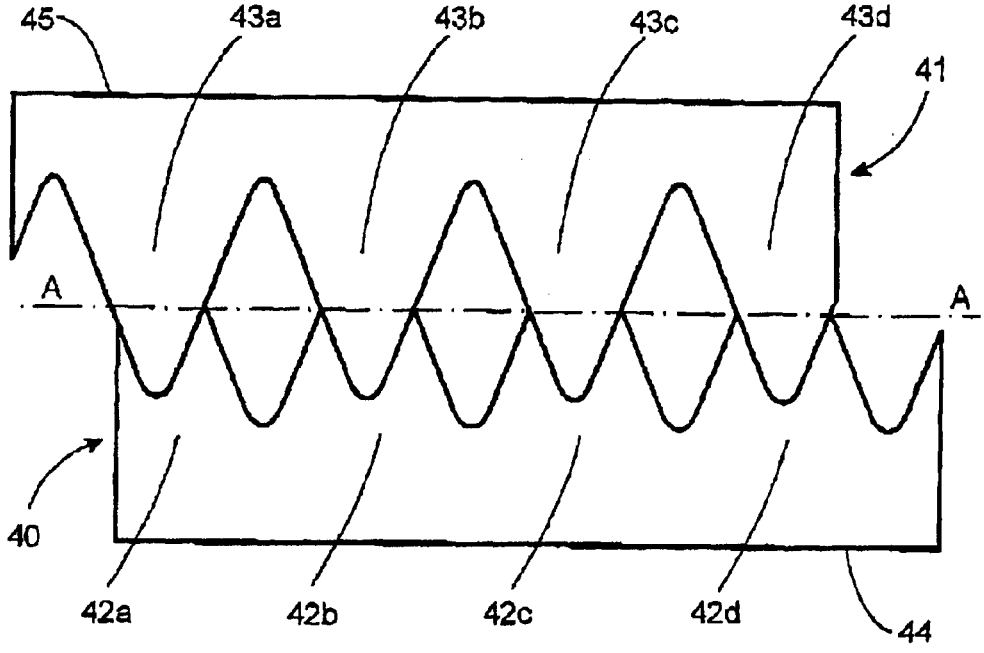
FIG. 6 shows a plan view of positioning means according to a third embodiment of the invention.

An alternative embodiment, using the same "V"-shaped positioning means 40, 41, is shown in FIG. 6. In this case the projections 42*a–d*, 43*a–d* have the same degree of overlap as in FIG. 5, but have been indexed half the width of one projection along the longitudinal axis A of the dispensing opening in the box. The projections will then be positioned in pairs, directly opposite each other. The main difference between the embodiments of FIG. 5 and FIG. 6, is that the former is mainly suited for tissue-sheets made from a thicker and/or stiffer material, as the interdigitated projections are in part dependent on the tissue-sheet for support. The latter is better suited for thinner materials than the former, as the directly opposing projections as shown in FIG. 6 will support both the tissue-sheet and each other. However, as the embodiment of FIG. 6 is equally suited for thicker tissue materials, it is more versatile than that shown in FIG. 5.

The positioning means and its projections are preferably made from a relatively thin plastic material, as stated above. On one hand it must be sufficiently flexible to allow the user easy access to the first top tissue-sheet, but on the other hand it must also be sufficiently stiff to be able to support the tissue-sheet in a substantially upright position. Examples of suitable materials are plastics, such as polyethylene, paper, metal foil or laminated materials, e.g., polyethylene and paper. The choice of material depends on the configuration of the dispensing opening, the configuration of the projections and the type of tissue to be dispensed. For the same reasons the material thickness may vary between 20 and 900 μm.

The invention also relates to a method of manufacturing the means for positioning tissue-sheets for use in a container for dispensing tissue sheets. Said method involves the use of a cutting device, the cutting edge of which has a profile identical to a set of projections to be used as positioning means. The cutting device may be reciprocating or rotary and is used for simultaneously cutting opposing sections of positioning means from a single continuous sheet of material. Examples of this can be seen in FIG. 5, showing a simple "V"-shaped cut, and FIG. 7, showing a more complex cut used for the embodiment of FIGS. 1 and 2.

In the case of FIG. 5, a continuous sheet of material is cut, resulting in two identical halves, after which the two halves of said sheet are indexed and cut to predetermined lengths, in order to make identical but opposed pairs of positioning means having opposed projections in contacting overlap. Also, by cutting identical, opposing pairs of sections, which are interfitting, the waste of material is negligible.

Figure 7:
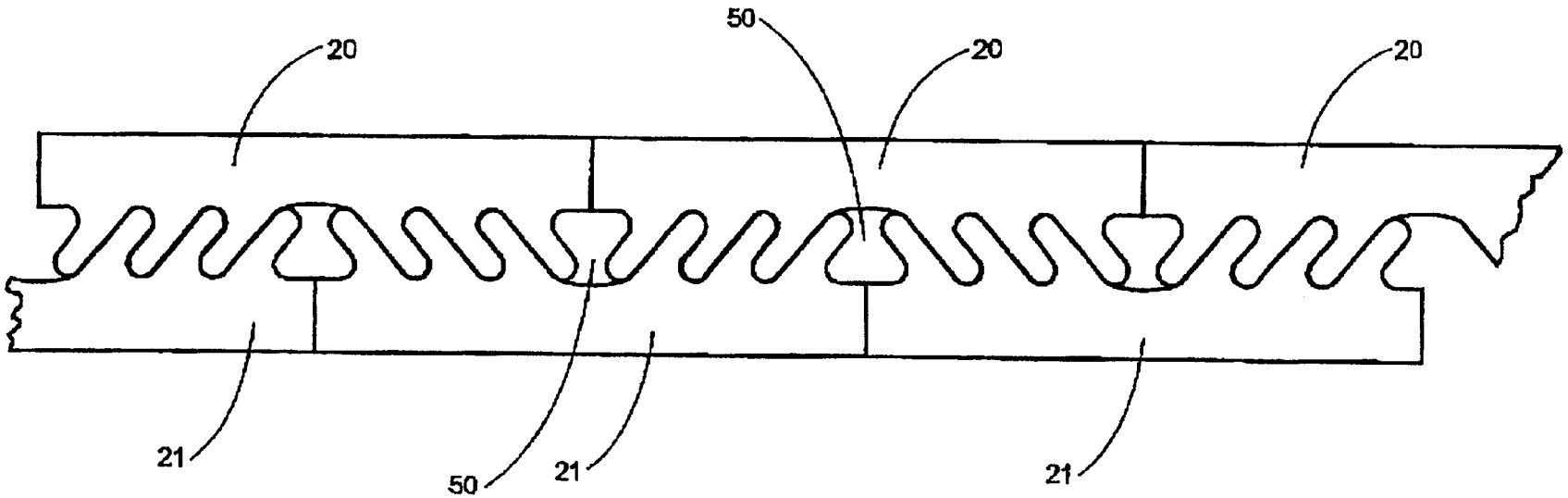
FIG. 7 shows a continuous sheet of material from which positioning means according to the first embodiment has been cut.

This is also the case for the example in FIG. 7, although the cutting device used is considerably more complex. In addition, the sections 20, 21 are cut indexed by a distance corresponding to half the length of a section, and a small waste section 50 must be removed by a subsequent cutting operation to produce the central dispensing opening. By selecting appropriate lengths and angles for the projections, making the tips of the outer projections of two adjacent sections 21 meet, the waste section 50 can be minimized and cut out at the same time as the projections. A prerequisite for this embodiment is that the angle $\alpha$ is constant for all of the projections. However, for the alternative embodiment where the angle $\alpha$ of the projections varies along the length of the section, a wider sheet of material is required. This is necessary as the cutting device has to be provided with a pair of identical cutting edges, both indexed and/or separated transversely in relation to the direction of feed of the sheet. The amount of indexing and/or transverse separation required is dependent on the complexity of the projections to be cut. Although this allows for the cutting of very complex shapes, the amount of waste material is increased. The sections may be cut to length by the profiled cutting means, as the projections are being cut. However, in a preferred embodiment, the cut sections 20, 21 are separated into two continuous parallel sheets, whereafter a first sheet, e.g., 20 is temporarily diverted from the second sheet 21. This can be done by passing the sheet 20 to be diverted over a pair of additional rollers. This diversion must be sufficient to cause the sheet 20 to be indexed the length of half a section 20, 21. When the first sheet 20 is guided back to run parallel with the second sheet 21, they will be positioned to allow them to be cut simultaneously along a straight transverse line.

What is claimed is:

1. A container for a collection of interfolded or mechanically connected tissue-sheets, said container comprising a generally planar bottom wall and a top wall and side walls connecting said bottom wall with said top wall and an opening provided in at least said top wall for the removal of the tissue-sheets from the container, wherein the opening is provided with flexible, elongated, overlapping projections extending from opposite sides of the opening, said projections having an initial substantially planar configuration and, after withdrawal of a first tissue sheet, an active substantially upright configuration, and wherein, in said initial configuration, said overlapping projections are arranged such that at least a portion of one said projection is over or under at least a portion of another said projection.

2. A container according to claim 1, wherein said overlapping projections are arranged on both sides of a section of the uppermost tissue-sheet to be dispensed, holding it substantially flat.

3. A container according to claim 1, wherein in said initial configuration said overlapping projections are arranged directly opposite each other and in contacting overlap on both sides of the opening.

4. A container according to claim 1, wherein said opening has a longitudinal axis defining opposing longitudinal sides, wherein in said initial configuration said overlapping projections are arranged opposite and at an angle relative to the longitudinal axis of the opening on both sides of the dispensing opening.

5. A container according to claim 4, wherein each of said projections overlaps one or more opposing projections.

6. A container according to claim 5, wherein the projections are angled between 5° and 90° relative to the longitudinal axis of the opening.

7. A container according to claim 6, wherein said opening has a central, transverse plane defining opposing transverse sides, wherein projections on one transverse side of the opening are angled away from projections on said opposing transverse side of the opening, said angled projections being on the same longitudinal side of the opening.

8. A container according to claim 7, wherein the angle of the angled projections decreases relative to a distance from said transverse plane.

9. A container according to claim 1, wherein the degree of overlap between two opposing and adjacent projections, equaling the ratio of the distance between the tips of the two projections, and the distance between opposing edges of the opening in a transverse plane through the tips of the projections, is between 50% and 100%.

10. A container according to claim 1, wherein, in said active configuration, said overlapping projections extend from either side of the opening and upwards on both sides of the uppermost tissue-sheet, in order to hold said tissue-sheet in a fixed position.

11. A container system for a collection of interfolded or mechanically connected tissue-sheets, comprising:

a container comprising a generally planar bottom wall and a top wall and side walls connecting said bottom wall with said top wall and a dispensing opening provided in at least said top wall for the removal of said tissue-sheets from the container, and a stack of interfolded tissue-sheets disposed in said container with at least a pair of edges of a lowermost tissue-sheet placed on said bottom wall and an uppermost tissue sheet placed near or in contact with the top wall and adjacent to the dispensing opening in the top wall, wherein the dispensing opening is provided with flexible, elongated, overlapping projections extending from opposite sides of the opening, said projections having an initial substantially planar configuration and, after withdrawal of the uppermost tissue sheet, an active substantially upright configuration, wherein said overlapping projections define a through-space to said stack of tissue sheets for enabling a user to access the uppermost tissue sheet for withdrawal, and wherein, in said initial configuration, said overlapping projections are arranged such that at least a portion of one said projection is over or under at least a portion of another said protection.

12. A container system according to claim 11, wherein, in said initial configuration, said overlapping projections are arranged staggered opposite and between each other on both sides of the dispensing opening such that said projections overlap only in a horizontal plane.

* * * * *